United States Patent [19]

Schellenger

[11] Patent Number: 4,745,651

[45] Date of Patent: May 24, 1988

[54] MULTI-PURPOSE UTILITY TOOL

[76] Inventor: Bernard G. Schellenger, P.O. Box 5622, Eugene, Oreg. 97405

[21] Appl. No.: 98,276

[22] Filed: Sep. 18, 1987

[51] Int. Cl.[4] ..... B25F 1/00

[52] U.S. Cl. ..... 7/158; 7/166; 254/131.5

[58] Field of Search ..... 7/158, 166, 169; 30/169, 172; 254/17, 25, 131.5, 131

[56] References Cited

U.S. PATENT DOCUMENTS

| | | | |
|---|---|---|---|
| 3,467,405 | 9/1969 | Fogg | 254/131 |
| 3,587,121 | 6/1971 | Morrow | 254/131 |
| 3,836,119 | 9/1974 | Saucier et al. | 254/131 |

FOREIGN PATENT DOCUMENTS

| | | | |
|---|---|---|---|
| 1063092 | 9/1979 | Canada | 254/25 |

*Primary Examiner*—Roscoe V. Parker
*Attorney, Agent, or Firm*—John F. Ingman

[57] ABSTRACT

A multi-purpose utility tool wherein an elongated straight handle is attached to a curved plate, the curvature occurring between a front edge and a back edge and being concave with respect to the top surface of the plate. The two side edges of the plate are mutually parallel and intersect the front edge at a right angle. The front edge is sharpened, the cutting edge preferably formed by bevelling between the top surface of the plate and the front edge. The handle is attached to the top surface of the curved plate, with the longitudinal axis of the handle forming an obtuse exterior angle with the curved plate at the point of attachment. A solid web, with a curved exterior edge surface, is formed between the back edge of the curved plate and the handle, the solid web extending tangentially from the back edge of the plate and curving toward the handle so as to terminate at its intersection with the handle. An alternative configuration, in lieu of the curved web, extends the curved plate until that plate reintersects the handle, thereby providing a broader continuous fulcrum-contacting surface than the narrower web. A guide element may be added to a side edge of the tool in order to guide the cutting edge. A two-wheel dolly may be attached transversely across the curved plate to provide means for wheeled movement.

7 Claims, 2 Drawing Sheets

MULTI-PURPOSE UTILITY TOOL

BACKGROUND OF THE INVENTION

1. Field of the Invention

The present invention generally relates to a hand tool, and, more particularly, a multi-purpose utility tool capable of performing the functions of lifting, prying, and cutting.

2. Description of the Prior Art

Numerous tool have been designed for specific purposes, but little has been done to design a single tool to accomplish a number of operations. The result is a maze of tools which generally are unsuitable except for their particular design purpose. An example in point is the common pry bar. Available in several shapes, it generally comes with a relatively blunt edge, a narrow width which may cause damage to the fulcrum material when pressure is applied, and a shape which generally is not conducive to lifting.

A need exists for a sturdy tool which is effective in a variety of cutting, prying and lifting operations. Such tool should be shaped to facilitate prying and lifting while minimizing fulcrum damage, and should have a broad sharpened forward edge for cutting and gaining access to narrow locations.

SUMMARY OF THE INVENTION

The present invention provides a multi-purpose utility tool which is designed to satisfy the aforementioned need. The invention involves a curved plate having a sharpened, straight front edge which is attached to an elongated handle, together with a continuous fulcrum-contacting surface.

Accordingly, in the preferred embodiment, the invention comprises an elongated straight handle to which is attached a curved plate, the curvature occurring uniformly between a front edge and a back edge and which is concave with respect to the top side of the plate. The two side edges of the plate are mutually parallel and intersect the front edge at a right angle. The front edge is sharpened for cutting and for slipping into narrow spaces for prying and lifting, the cutting edge preferably formed by bevelling between the top surface of the plate and the front edge. The handle is attached to the top surface of the curved plate, preferably by welding, with the longitudinal axis of the handle forming an obtuse exterior angle with the curved plate at the point of attachment. A solid curved web, with a curved exterior edge surface, is formed, in one preferred configuration, between the back edge of the curved plate and the handle, the solid web extending tangentially from the back edge of the plate and curving toward the handle so as to terminate at its intersection with the handle, thereby providing continuing fulcrum-contacting surface beyond the curved plate upon which the tool can be pivoted while prying or lifting.

A radius of curvature for the curved plate of between nine and twelve feet is preferred, along with an exterior angle of intersection between the handle and the top side of the curved plate of between 150 and 160 degrees.

An alternative configuration, in lieu of the curved web, extends the curved plate until that plate reintersects the handle, thereby providing a broader, albeit heavier and bulkier continuous fulcrum-contacting surface than the narrower web.

A guide element may be added to a side edge of the tool in order to guide the tool, particularly in cutting operations.

A wheeled element may be added to the curved plate to provide a dolly for enhancing mobility in transporting a load, a feature which is especially useful in conjunction with lifting operations.

DESCRIPTION OF THE PREFERRED EMBODIMENT

Figure 1:
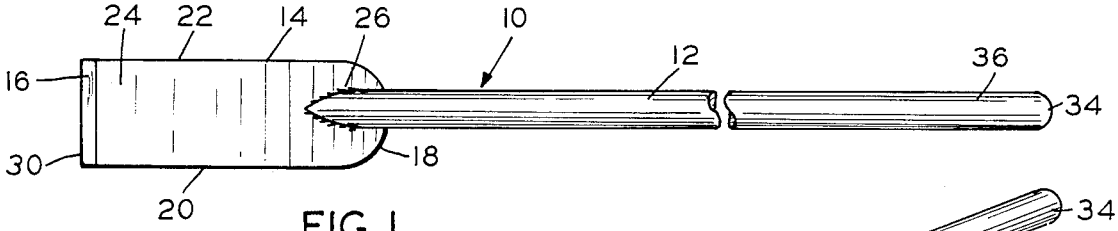
FIG. 1 illustrates a top view of the multi-purpose utility tool.
Figure 2:
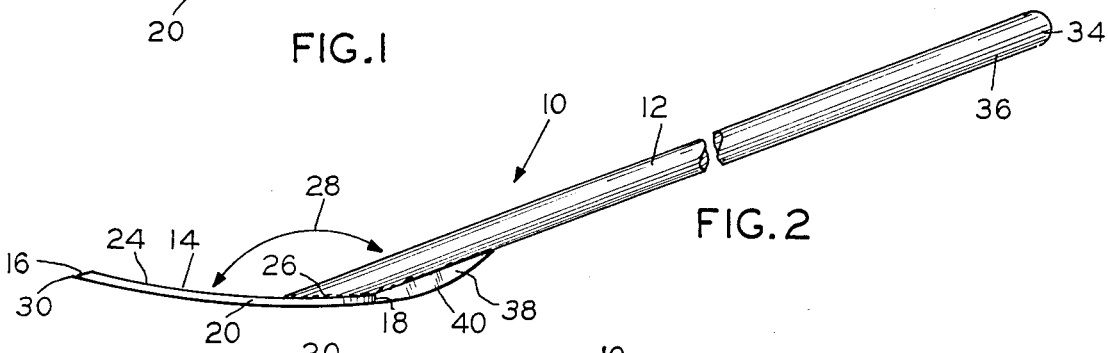
FIG. 2 illustrates a side view of the multi-purpose utility tool.
Figure 3:
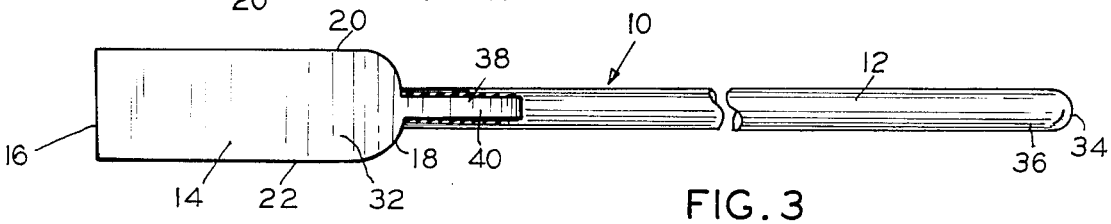
FIG. 3 illustrates a bottom view of the multi-purpose utility tool.

Referring to the various drawings, and particularly the views of FIG. 1, 2 and 3, there is shown a preferred embodiment of the multi-purpose utility tool 10. An elongated handle 12 is attached, as by welding, to a curved plate 14. The curved plate, formed of ¼-inch steel, curves uniformly between its front edge 16 and its back edge 18, with the radius of curvature of the curved plate 14 being between nine and twelve feet, this radius of curvature appearing to be most suitable for the multiple uses of the utility tool. Similarly, to maximize usefulness, the preferred length between the front edge 16 and back edge 18 is six to eight inches; the preferred width of the curved plate 14 between the two side edges 20 and 22 is between 2½-and four-inches. The two side edges 20, and 22 are mutually parallel and the curved plate 14 between the two side edges 20 and 22 is flat, the curvature being between the front edge 16 and the back edge 18, as indicated above. The top surface 24 of the curved plate 14, which is concave in shape, is attached to the lower end 26 of the handle 12, as by welding. The exterior angle of attachment 28 of the handle 12 to the top surface 24 of the curved plate 14, as illustrated, is within the range of 140 to 170 degrees, and is preferred to be between 150 to 160 degrees, this angle 28 also being determined to maximize usefulness of the tool in various applications.

The front edge 16 of the curved plate 14 is sharpened to provide a straight cutting edge 30 for cutting functions, and for entering narrow spaces to engage an object in prying and lifting operations. It is found preferable to provide the cutting edge 30 by bevelling the front edge 16 of the curved plate 14 between the top surface 24 and the front edge 16, thereby retaining a smooth bottom surface 32 for fulcrum applications.

In the above discussed preferred embodiment, the preferred handle 12 is approximately thirty inches in length and may be made of one-inch outside diameter steel pipe, hemispherically capped 34 at its upper end 36.

Finally, a solid steel web 38 is formed, as by welding, between the back edge 18 of the curved plate 14 and the handle 12, as illustrated. The web 38, approximately ½-inch in width, extends tangentially from the back edge 18 of the curved plate 14, and with increasing curvature intersects the handle 12 three to five inches above the lower end 26 of the handle 12. Such web 38 provides additional support to the connection of the handle 12 to the curved plate 14, and, more importantly, also provides a continuing fulcrum-contacting surface 40, extending beyond the bottom surface 32 of the curved plate 14, so as to afford increased prying and lifting capability.

Thus described, the preferred embodiment of the multi-purpose utility tool 10 provides a sturdy tool with a capability for numerous uses never available in a single tool before.

Figure 4:
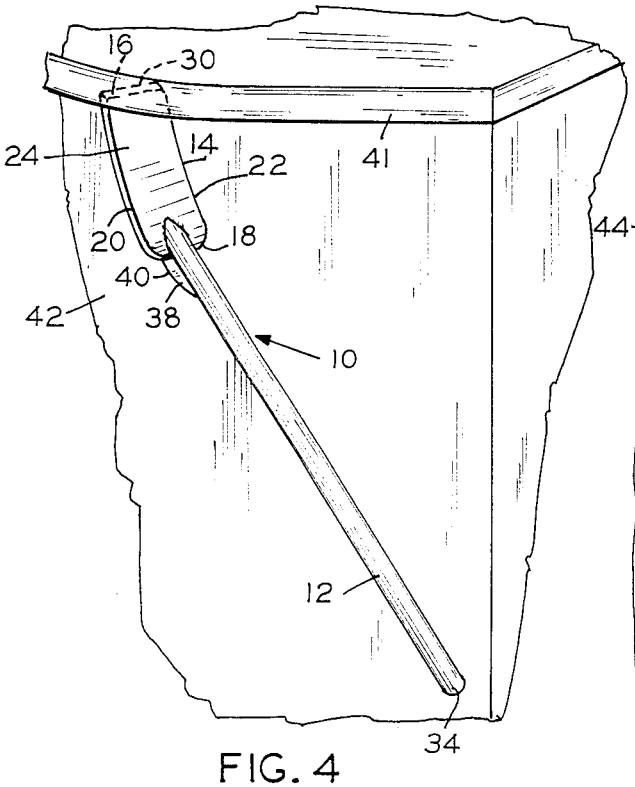
FIG. 4 shows the multi-purpose utility tool in use as it prys loose a ceiling molding.
Figure 5:
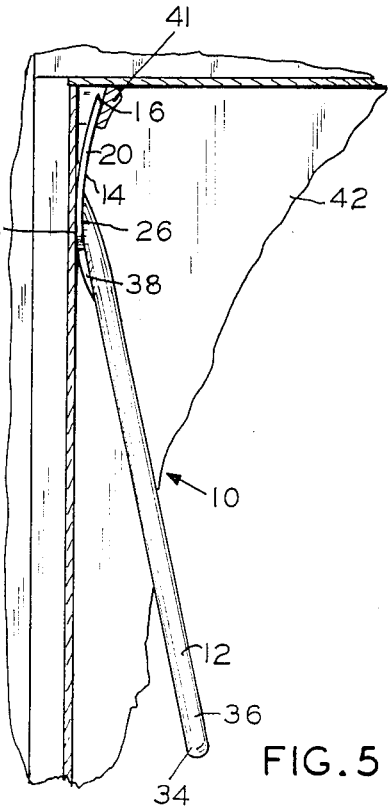
FIG. 5 shows a cross-section view of the ceiling wall molding removal of FIG. 4.

FIG. 4 and FIG. 5 illustrate the utility tool 10 as used to pry loose a molding 41 from a wall 42, in this case a ceiling molding 41. The sharpened front edge 16 is inserted between the molding 41 and the wall 42 and the top end 36 of the handle is moved toward the wall 42, so that the utility tool 10 pivots about that portion 44 of the bottom surface 32 of the curved plate 14 in contact with the wall 42, causing the front edge 16 to move outwards and the molding 40 to separate from the wall 42 to allow removal. The utility tool 10 pivots on the full width of the bottom surface 32 of the curved plate 14, thereby minimizing or eliminating damage to the wall 42 caused by the force of the pivoting surface 44 against the wall in applying leverage to the outward movement of the front edge 16 beneath the molding 40. Numerous other prying operations would utilize similar technique.

Figure 6:
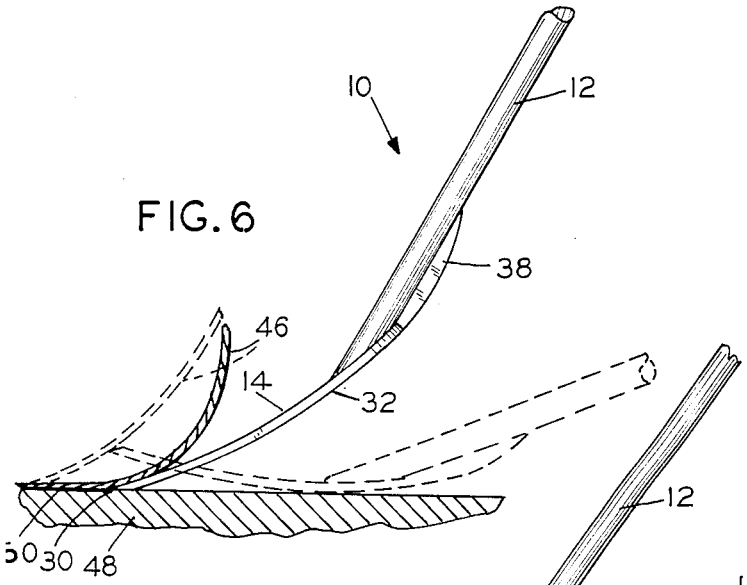
FIG. 6 shows the multi-purpose utility tool in use in a cutting and prying operation as in the removal of linoleum, carpeting, or other flooring.

FIG. 6 illustrates another of many uses for the utility tool 10, the removal of linoleum, carpeting or other floor covering 46. The sharpened front edge 16 is placed between the floor covering 46 and the subfloor 48 where the cutting edge 30 cuts into any binding material 50. Having achieved a purchase with the front edge 16, the utility tool 10 is then pivoted about the bottom surface 32 of the curved plate 14, thereby forceably lifting the floor covering 46 from the subfloor 48 as shown in dashed lines. Minimum damage to the subfloor 48 is assured by the broadness of the bottom surface 32 of the pivoting curved plate 14, while the wide front edge 16 creates a broad grip beneath the floor covering 46 to apply greater force with a minimum tearing effect.

Figure 8:
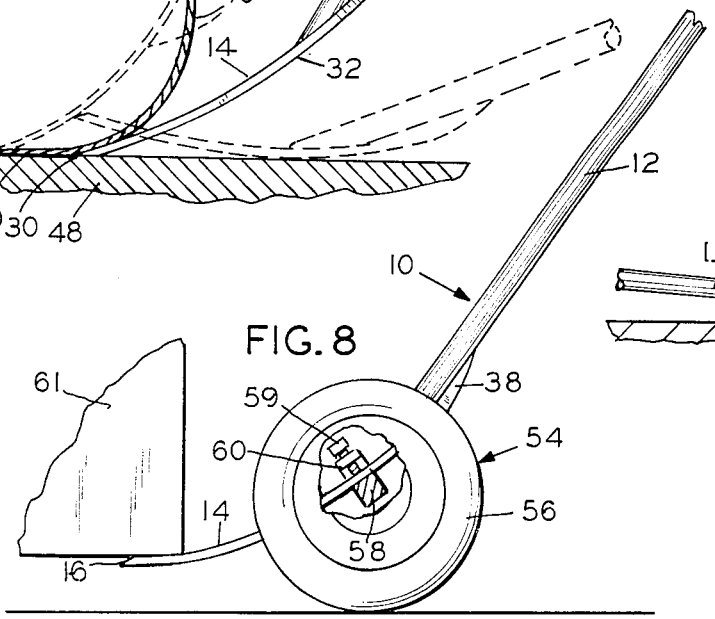
FIG. 8 shows a side view of the multi-purpose utility tool with the supplementary wheel mechanism of FIG. 7 as attached and used in a lift-and-move operation.
Figure 7:
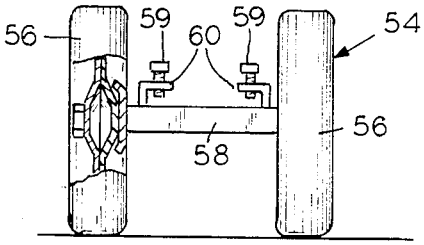
FIG. 7 illustrates a front view of a supplementary wheel mechanism for attachment to the multi-purpose utility tool.

FIG. 7 illustrates a two-wheel dolly 54 designed for attachment to the curved plate 14. The wheels 56 rotate upon an axle 58 in a conventional manner; connected to the axle 58 are two L-shaped brackets 60 through which bolts 59 are threaded so as to grasp the curved plate 14 when placed between the brackets 60. FIG. 8 shows the utility tool 10, with dolly 54 attached, in use. The curved plate 14 pivots about the axle 58 to provide leverage at the front edge 16 in the lifting of, for example, the crate 61. Once lifted, say by several of the utility tools 10 with dolly 54 attached, the crate 61 can be easily moved. Even a single utility tool 10 with dolly 54 can be used to walk a heavy object from place to place. Such a combination is invaluable for warehouse work, or even in the residence, where it can be used to move heavy appliances, as for servicing.

Figure 9:
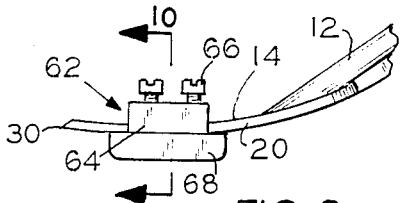
FIG. 9 illustrates a side view of a guide attachment which is a fastened to the multi-purpose utility tool as could be used to guide the cutting edge in a scraping or cutting operation.
Figure 10:
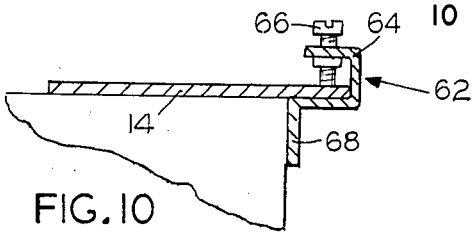
FIG. 10 shows a cross section of the guide attachment on the tool as seen at line 10—10 of FIG. 9.

FIG. 9 and FIG. 10 illustrate a guide 62 which is attachable to either side edge, 20 or 22, (20 as illustrated) of the curved plate 14 to guide and limit the movement of the curved plate 14 and especially of the cutting edge 30 when used in a cutting operation, such as shaving as a slick on boat caps. FIG. 10 shows a cross section of the guide 62 comprising U-shaped member 64 fastened by threaded bolts 66 locking onto the curved plate 14 and connecting to a flat guide edge 68.

Figure 11:
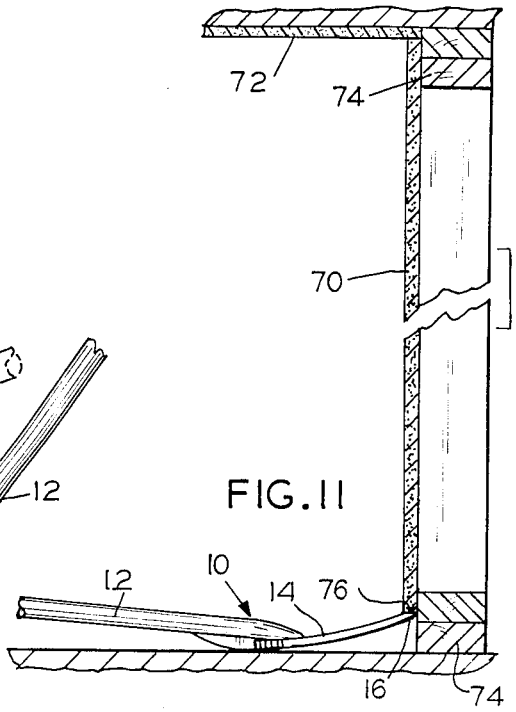
FIG. 11 shows the multi-purpose utility tool used as a lifting tool in the raising of a section of drywall for installation.

FIG. 11 shows the utility tool 10 being applied in a lifting mode, the application being the lifting of a section of drywall 70 to the ceiling 72 so as to be attached at that location to structural members 74 by conventional means. The sharpened front edge 16 having been inserted under the lower edge 76 of a section of drywall 70, the handle 12 is forceably lowered, raising the drywall 70 appropriately by pivoting, as illustrated, about the curved surface 40 of the web 38.

Figure 12:
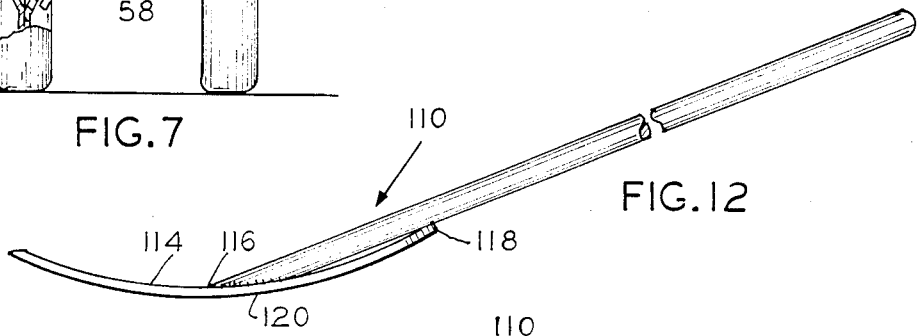
FIG. 12 illustrates a side view of an alternative configuration of the multi-purpose utility tool having an extended curved plate.
Figure 13:
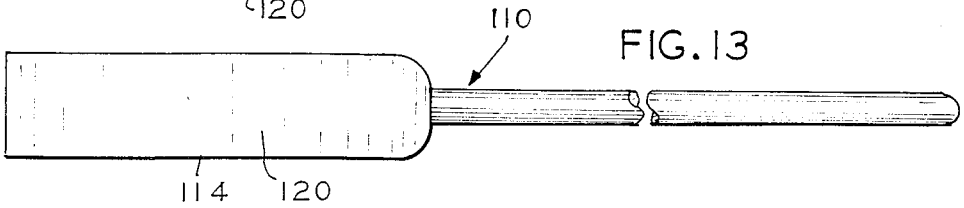
FIG. 13 illustrates a bottom view of the alternative configuration of FIG. 12.

FIG. 12 and FIG. 13 show two views of an alternative configuration utility tool 110 wherein the curved plate 114 extends beyond its attachment, as by welding, to the handle 112 at location 116, so that the curved plate 114 reintersects with, and is attached, as by welding, to the handle 112 at location 118. Location 118 will depend upon the curvature of the plate 114, particularly beyond location 116. The continuation of the curving plate 114 thus provides a continuing broader bottom surface 120 for pivot positions which, in the first configuration, rely on the curved surface 40 of web 38 for the fulcrum-contacting part of the utility tool 10. While heavier and bulkier than the utility tool 10, this alternative configuration 110 has application when greater movement of handle 112 in conjunction with the need for a broad pivot surface as at 120, is indicated by the desired use.

It is thought that the multi-purpose utility tool of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A multi-purpose utility tool, comprising:

a. a handle;

b. a curved plate, having a top surface and a bottom surface, a front edge, two side edges and a back edge, wherein the front edge is straight and sharpened so as to form a cutting edge along the front edge;

the curvature of the curved plate occurs between the front edge and the back edge, and is concave with regard to the top surface; and the two side edges are mutually parallel and intersect the front edge at a right angle;

c. an end of said handle is attached to the top surface of said curved plate, with the longitudinal axis of said handle forming an obtuse exterior angle with said curved plate at the point of attachment; and d. a curved web is formed, between the back edge of the curved plate and the handle, which extends tangentially from the bottom surface at the back edge of the curved plate so as to curve toward said handle until intersection therewith, the curved web thereby forming a continuing fulcrum-contacting surface upon which the tool can pivot while prying or lifting, as well as providing additional strength to the attachment between the curved plate and the handle.

2. A multi-purpose utility tool, as recited in claim 1, wherein the radius of curvature of the curved plate is between nine feet and twelve feet.

3. A multi-purpose utility tool, as recited in claim 1, wherein the exterior angle between the handle and the top surface of the curved plate is between 150 degrees and 160 degrees.

4. A multi-purpose utility tool, as recited in claim 1, wherein the cutting edge is formed by bevelling between the top surface of said plate and the front edge.

5. A multi-purpose utility tool, as recited in claim 1, wherein a guide element is attached to a side edge of the curved plate and extends transversely beyond said side edge so as to form a guiding surface for controlling movement of the cutting edge.

6. A multi-purpose utility tool, as recited in claim 1, wherein a two-wheel dolly is attached transversely across the curved plate so as to form a means for wheeled movement of the utility tool.

7. A multi-purpose utility tool, comprising:

a. a handle;

b. a curved plate, having a top surface and a bottom surface, a front edge, two side edges and a back edge, wherein the front edge is straight and sharpened by bevelling from the top surface of said plate to the front edge so as to form a cutting edge along the front edge;

the curvature of the curved plate occurs between the front edge and the back edge with a radius of curvature between nine feet and twelve feet, and is concave with regard to the top surface; and the two side edges are mutually parallel and intersect the front edge at a right angle;

c. an end of said handle is attached to the top surface of said curved plate, with the longitudinal axis of said handle forming an obtuse exterior angle of between 150 degrees and 160 degrees with said curved plate at the point of attachment; and d. a curved web is formed, between the back edge of the curved plate and the handle, which extends tangentially from the bottom surface at the back edge of the curved plate so as to curve toward said handle until intersection therewith, the curved web thereby forming a continuing fulcrum-contacting surface upon which the tool can pivot while prying or lifting, as well as providing additional strength to the attachment between the curved plate and the handle.

* * * * *